United States Patent [19]

McLennand

[11] 3,993,111

[45] Nov. 23, 1976

[54] CONTAINER-FILLING MACHINE WITH LEVEL SENSING AND BLOWDOWN

[75] Inventor: Richard G. McLennand, Coraopolis, Pa.

[73] Assignee: Horix Manufacturing Company, Pittsburgh, Pa.

[22] Filed: May 15, 1975

[21] Appl. No.: 577,834

[52] U.S. Cl. ..... 141/90; 141/198; 141/285

[51] Int. Cl.[2] ..... B65B 3/04

[58] Field of Search ..... 141/4, 5, 39, 40, 46, 141/90, 285, 301, 302, 308, 392, 198

[56] References Cited

UNITED STATES PATENTS

| | | | |
|---|---|---|---|
| 3,580,298 | 5/1971 | Trusselle | 141/40 |
| 3,760,852 | 9/1973 | Waxlax | 141/40 |

*Primary Examiner*—Richard E. Aegerter
*Assistant Examiner*—Frederick R. Schmidt
*Attorney, Agent, or Firm*—Brown, Murray, Flick & Peckham

[57] ABSTRACT

A level-sensing collar is rigidly mounted on a vertical tubular nozzle of a container-filling machine. The collar is located a predetermined distance above the nozzle outlet and is provided in its bottom with an upwardly extending recess encircling the nozzle. The collar also has a plurality of circumferentially spaced openings connecting its recess with the lower ends of air tubes that extend up along the nozzle to air-receiving means that first receives high pressure air to blow down out of the collar recess any product that has accumulated in it and then receives low pressure air for delivery to the collar recess so that when the level of the product in a surrounding container rises high enough to close the recess the air pressure in the tubes will built up and shut off the delivery of the product to the container.

5 Claims, 3 Drawing Figures

CONTAINER-FILLING MACHINE WITH LEVEL SENSING AND BLOWDOWN

In U.S. Pat. No. 3,760,852 a container-filling machine nozzle is shown that is encircled by a level-sensing tube, to the upper end of which low pressure air is delivered continuously while a container is being filled. When the liquid product level in the container reaches the lower end or outlet of the sensing tube and closes it, the air pressure in the tube and its supply line builds up and trips a switch that opens an air valve so that the valve that controls the product flow will close. In this way, every container is filled to the same level. Such apparatus operates satisfactorily in most cases, but with semi-liquid or viscous products there is a tendency for the heavy product to accumulate in the lower end of the sensing tube. To clear the level-sensing tube of this accumulation before each filling, it is the practice to deliver high pressure air to its upper end in order to blow the product out of its lower end. This blowdown takes place into a container just before the product valve is opened. However, it has been found in some cases that where the product is of sufficient viscosity, the blowdown may not completely open the outlet of the sensing tube and the surface tension of the remaining product may cause it to again close the outlet. This will interfere with the proper operation of the machine.

It is among the objects of this invention to provide in a container-filling machine a filling nozzle that is provided with level-sensing means which can be cleared of even highly viscous product, and which does not require any change in the presently used general blowdown system connected with the level-sensing means.

Figure 1:
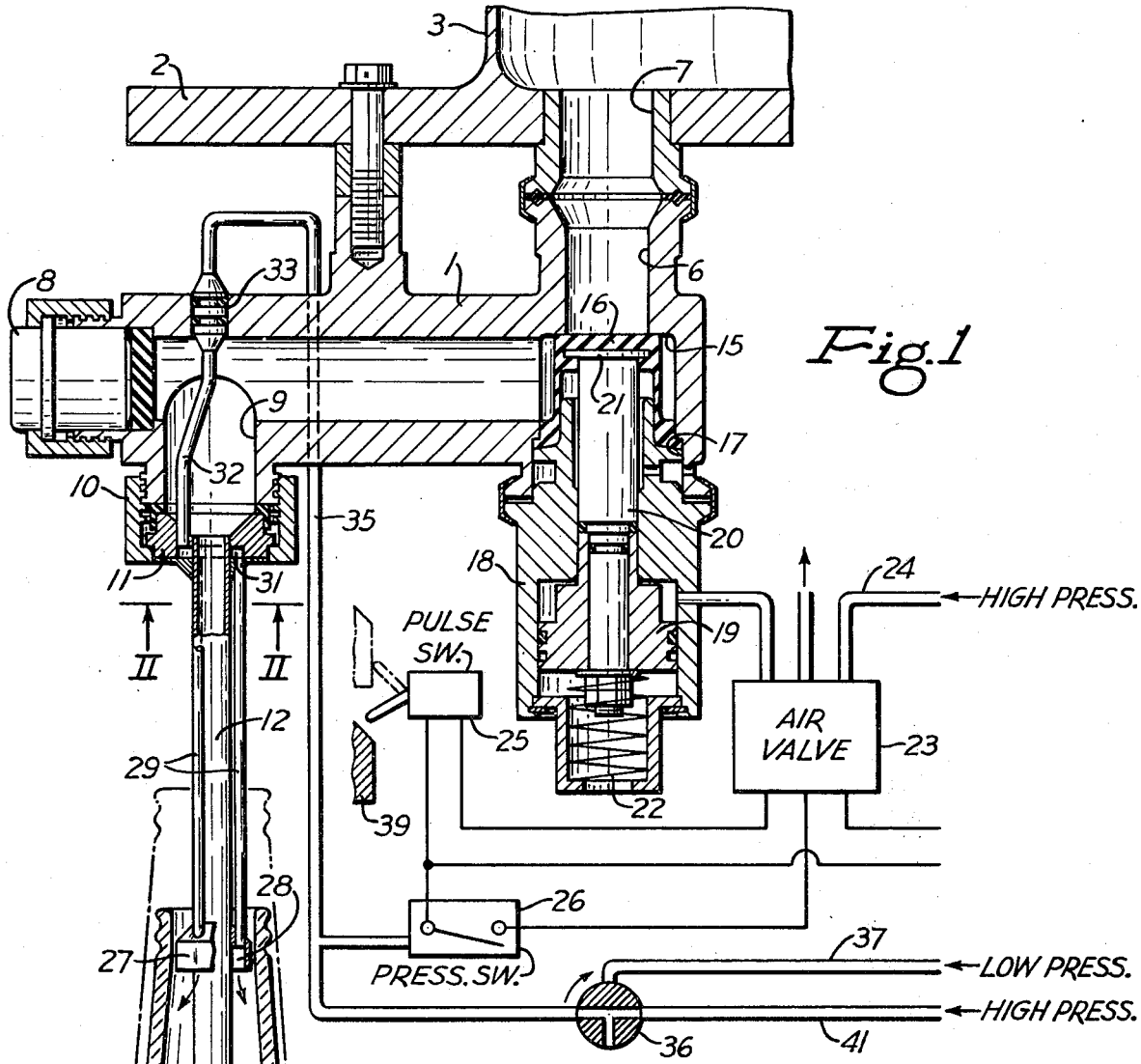
Figure 2:
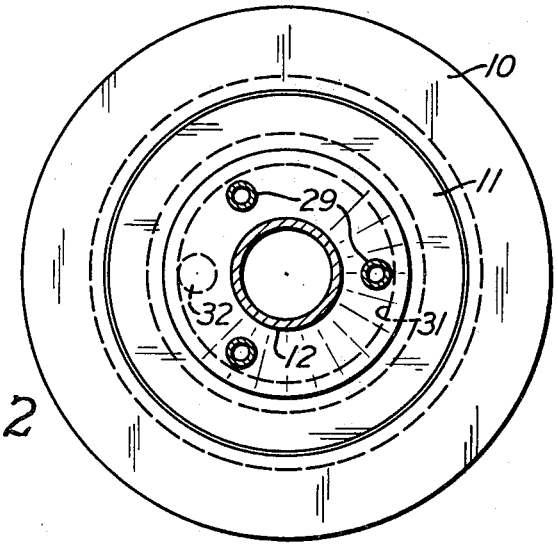
Figure 3:
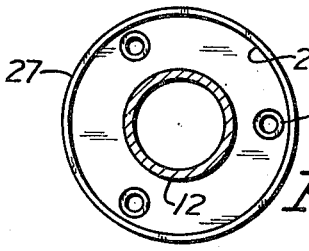

The preferred embodiment of the invention is illustrated in the accompanying drawings, in which FIG. 1 is a fragmentary vertical section through a single filling station of a container-filling machine, with some parts shown diagrammatically; and FIGS. 2 and 3 are enlarged horizontal sections taken on the line II—II and III—III, respectively, of FIG. 1.

The type of container-filling machine with which this invention is most useful is the kind in which several filling stations are spaced circumferentially around a center post (not shown). At each station there is a horizontal radial arm 1 supported from a rotary table 2 and movable with it in a circle around the axis of the center post. The table supports a tank 3 filled with the semi-liquid product that is to fill containers 4 carried through the machine and raised at the filling stations in a well-known manner.

The arm 1 is hollow and is provided at its inner end with a vertical inlet passage 6 communicating with an outlet 7 from the tank. The opposite end of the arm is closed by a plug 8. The bottom of the arm near the plug is provided with a downwardly extending outlet passage 9 connected by a nut 10 with a coupling ring 11 that supports a vertical tubular nozzle 12 that is long enough to extend down into the container being filled with the product from the tank. The lower end of the nozzle has an outlet, which may be simply an opening or a porous tip 13.

At the lower end of the inlet passage 6 of the arm there is a valve seat 15 that normally is closed by a flexible valve member 16 sealed at its lower end in an opening 17 in the bottom of the arm. Rigidly mounted in this opening is the upper end of a valve cylinder 18 containing a piston 19 that has a rod 20 extending upwardly from its upper end into the valve member.

The top of the rod is provided with a radial flange 21 embedded in the upper part of the valve member so that when the rod is moved downwardly by the piston, the valve will be opened. When air pressure is released from above the piston, a coil spring 22 beneath it moves the piston upwardly to close the valve.

Air is admitted to and released from the cylinder above the piston by means of an electrically operated air valve 23, to which high pressure air is delivered through a line 24 from a suitable source. This valve normally connects the valve cylinder 18 with the atmosphere, but when the air valve is shifted to its other position, it connects the high pressure air line to cylinder 18. To operate the valve for this purpose, an electric pulse switch 25 is electrically connected with it. Among the various types of air valves that can be used, a satisfactory valve is the Magnalatch valve manufactured by the Skinner Electric Valve Division of Skinner Electric Industries, Inc., New Britain, Connecticut. When this valve is energized by a pulse of electric current, it takes a latched position in which it is held by a permanent magnet until unlatched by the subsequent closing of another circuit. This second circuit contains a normally open pressure switch 26. In its latched position, the air valve connects the high pressure air line 24 with the cylinder to open product valve 16. In its unlatched position the valve releases the air from the cylinder so that the product valve can close.

At a predetermined distance above its outlet, the nozzle tube 12 is encircled by a level-sensing collar 27 that is sealed against it. The bottom of this collar is located at the level to which containers are to be filled. The collar is provided with a central recess 28 that extends upwardly into it from its bottom and encircles the nozzle. The top of the collar is provided with a plurality of vertical openings through it spaced uniformly around the nozzle. Preferably, there are three or more of these openings. Rigidly mounted in them are the lower ends of tubes 29 that extend upwardly along the nozzle to the coupling ring 11 at its upper end.

The coupling ring is provided with vertical openings connecting the upper ends of these tubes with the bottom of an internal radial groove 31 extending around the nozzle tube. The top of this groove is connected by an opening through the coupling with the lower end of a tube 32, that extends up through outlet passage 9 of arm 1 and through a sealed opening 33 in the top of the arm. The upper end of this tube is connected by a tube 35 and a conventional three-way valve 36 with a low pressure air line 37. During container filling, the air will flow through coupling ring 11 and down through the three air tubes 29 and into collar 27, from the bottom of which it will issue all around the nozzle.

When a container is raised up around the nozzle and the level-sensing collar 27 to its uppermost position, above that shown in the drawing, the upwardly moving bottle guide, only a portion 39 of which is shown, will trip the pulse switch 25, which will cause air valve 23 to connect the high pressure air line 24 with the valve cylinder 18 in order to open the product valve so that the liquid product will flow down through the nozzle and into the container. At the same time, low pressure air will flow down through coupling ring 11 and tubes 29 and into recess 28 in the level-sensing collar and out of its bottom. The liquid product will rise in the container until the upper surface of the liquid reaches the collar and closes the open bottom of its recess. This will cause the air pressure in the tubes above the collar to build up to the point where it is sufficient to close the product valve.

Since the collar recess 28 extends all around the nozzle, splashing or foaming of drops of liquid up into the collar during filling ordinarily will not close its recess enough to cause an appreciable increase in the air pressure inside of it. Therefore, the product valve 16 will not be closed prematurely, but will remain open until the liquid rises around the nozzle to a level where it will close the collar recess all around the nozzle. Only then will the air pressure in tube 35 increase sufficiently to close pressure switch 26, which will cause air valve 23 to connect cylinder 18 with the atmosphere so that the product valve will close. The result is that all containers will be filled to the same level.

Since there may be a tendency for some products to accumulate in the collar and thus affect the operation of the sensing tube, it is desirable to flush out or blow down the collar periodically. This is accomplished as a container starts to move up around the level-sensing collar as shown in FIG. 1, but before switch 25 has been tripped. At this time a cam (not shown) operates the three-way valve 36 to connect it with a high pressure air line 41 momentarily. The resulting surge of high pressure air to the coupling groove 31 is distributed through the three tubes 29 to the collar recess 28 in three different locations. With three streams of high pressure air flowing into the collar simultaneously for a moment, its recess will be cleaned of any accumulated product sufficiently to prevent interference with the proper operation of its level-sensing function.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. In a container-filling machine, the combination with a vertical tubular nozzle provided at its lower end with an outlet for discharging a semi-liquid product into a surrounding container, of a level-sensing collar rigidly mounted on the nozzle in sealing engagement therewith and provided in its bottom with an upwardly extending recess encircling the nozzle, the collar being spaced above the nozzle outlet and having a plurality of circumferentially spaced openings extending downwardly through it into said recess, air tubes connected to the upper ends of said openings and extending upwardly therefrom along the nozzle, air-receiving means connected with the upper ends of said tubes, means for supplying high pressure air to said air-receiving means for the tubes to deliver to said collar recess to blow down out of it any of said product that has accumulated in it, and means for then supplying low pressure air to said air-receiving means for the tubes to deliver to said collar recess.

2. In a container-filling machine according to claim 1, there being three of said collar openings and three of said tubes.

3. In a container-filling machine according to claim 1, said air-receiving means including a ring encircling the upper end of said nozzle and rigidly secured thereto, the ring being provided with an interior recess encircling the nozzle, the bottom of the ring having circumferentially spaced openings therein connecting the upper ends of said tubes with said ring recess, and said ring having a further opening communicating with its recess and forming an inlet for said air.

4. In a container-filling machine according to claim 3, there being three of said collar openings and three of said tubes and three of said tube-receiving openings in said ring.

5. In a container-filling machine according to claim 1, a tube connected with said air-receiving means, said air-supplying means including a valve provided with an outlet connected with said tube and having two inlets, means for conducting high pressure air to one of said inlets, means for conducting low pressure air to the other valve inlet, and means in said valve for first connecting said high pressure air and then said low pressure air with said valve outlet.

* * * * *